US007076839B2

(12) United States Patent
Schürenkrämer et al.

(10) Patent No.: US 7,076,839 B2
(45) Date of Patent: Jul. 18, 2006

(54) CARD TOP BAR FOR A CARDING MACHINE, HAVING A CARRYING MEMBER AND A CLOTHING PORTION

(75) Inventors: Michael Schürenkrämer, Mönchengladbach (DE); Armin Leder, Mönchengladbach (DE)

(73) Assignee: Trützschler GmbH & Co. KG, Monchengladbach (DE)

( * ) Notice: Subject to any disclaimer, the term of this patent is extended or adjusted under 35 U.S.C. 154(b) by 233 days.

(21) Appl. No.: 10/452,196

(22) Filed: Jun. 3, 2003

(65) Prior Publication Data

US 2004/0000034 A1 Jan. 1, 2004

(30) Foreign Application Priority Data

Jun. 28, 2002 (DE) ..... 102 29 172

(51) Int. Cl.
*D01G 15/02* (2006.01)

(52) U.S. Cl. ..... 19/102; 19/111; 19/113

(58) Field of Classification Search ..... 19/65 R, 19/98, 102, 104, 105, 108, 110, 111, 112, 19/113, 114

See application file for complete search history.

(56) References Cited

U.S. PATENT DOCUMENTS 3,737,953 A * 6/1973 Bechtel, Jr. ..... 19/113
3,793,677 A * 2/1974 Bechtel, Jr. ..... 19/113
4,221,023 A * 9/1980 Henderson et al. ..... 19/113
5,745,955 A * 5/1998 Patelli et al. ..... 19/102
6,269,522 B1 8/2001 Graf et al.
6,704,970 B1 * 3/2004 Ebenhoh et al. ..... 19/114

FOREIGN PATENT DOCUMENTS

| | | |
|---|---|---|
| DE | 100 07 268 C2 | 9/2001 |
| EP | 0 567 747 A1 | 11/1993 |
| EP | 0 794 271 A1 | 9/1997 |
| EP | 0 794 272 A1 | 9/1997 |
| EP | 1 219 735 A1 | 7/2002 |
| GB | 681885 | 10/1952 |
| GB | 2 379 939 A | 3/2003 |

* cited by examiner

*Primary Examiner*—Gary L. Welch
(74) *Attorney, Agent, or Firm*—Venable LLP; Robert Kinberg

(57) ABSTRACT

A card top bar for a carding machine, has a carrying member and a releasable clothing portion in which card top bar there are provided two card top heads, each of which slides on a slideway, the card top heads comprise at least one sliding region, which is in contact with the slideway, and at least one fixing region, which is in engagement with the rest of the card top bar and which at the same time holds the sliding region.

In order to improve the card top bar, the card top heads are in engagement with the carrier for the clothing.

14 Claims, 5 Drawing Sheets

CARD TOP BAR FOR A CARDING MACHINE, HAVING A CARRYING MEMBER AND A CLOTHING PORTION

CROSS REFERENCE TO RELATED APPLICATION

This application claims priority from German Patent Application No. 102 29 172.1, which is incorporated herein by reference.

BACKGROUND OF THE INVENTION

The invention relates to a card top bar for a carding machine, having a carrying member and a releasable clothing portion.

In a known card top bar there are provided two end headpieces (card top heads), each of which slides on a slideway, the end head-pieces comprising at least one sliding region, which is in contact with the slideway, and at least one fixing region, which is in engagement with the card top bar and which at the same time holds the sliding region. In that known card top bar, the end head-pieces (card top heads) are associated with the carrying member.

SUMMARY OF THE INVENTION

It is an aim of the invention to improve the known card top bar still further.

The invention provides a card top bar for a carding machine, having a carrying member and a releasable clothing portion, the clothing portion having clothing, a carrier for the clothing, and two card top heads, the card top heads comprising at least one sliding region arranged for sliding, in use, on a slideway, wherein the card top heads and the carrier for the clothing are in engagement with one another and form a structural unit.

The fact that the card top heads are in engagement with the carrier for the clothing makes it possible for the clothing portion, including the card top heads, to be manufactured as a separate component. In the process, it is made possible for a constant setting to be obtained for the important spacing between the sliding surface of the card top heads and the free ends (tips) of the clothing. Manufacturing tolerances in the carrying member, which is made, for example, from extruded aluminium, are substantially prevented from having an adverse effect on that spacing. A further advantage is that, when the clothing has become worn, the complete clothing portion (clothing strip, holding device and card top heads) can be removed and thrown away. It is especially advantageous that replacement of the clothing portion is carried out by simple means in the spinning room, it being possible for the carrying members to be re-used without modification. Precise setting of the card top heads relative to the clothing tips and, accordingly, of the important spacing between the clothing tips and the cylinder clothing (carding nip) is made possible by means of the measures according to the invention.

The carrier may be of one-piece construction. The carrier may instead consist of a carrying element for the clothing and a compensating layer which may be connected to one another. The compensating layer may be arranged between the carrier and the carrying member. The card top heads may be in engagement, preferably non-releasably, with the carrier, for example with a compensating layer thereof, for example, directly or by way of an auxiliary carrier.

The fixing region for the card top heads may be arranged in the compensating layer, for example with the sliding region extending outwardly beyond the carrier. Each card top head may have two elements, for example, pins of hardened steel or the like, the sliding surface of which may be ground, fine-ground and/or polished. The card top heads may be fixed in the respective end face of the carrier. Advantageously, the lower boundary of the card top heads is spaced from the free clothing tips. The carrying member and the clothing portion may form at least two composite components. The clothing portion advantageously comprises the carrier, the clothing and the card top heads. The carrying member and the clothing portion are advantageously connected to one another by releasable fixing means, for example, clips, clamps or the like. Fixing means, for example, resilient snap-fit elements, may be attached to the carrying member or to the clothing portion.

The card top heads maybe connected to the carrier by adhesive action or the like. Advantageously, at least one continuous rod or the like, advantageously of a wear-resistant material, is provided, which extends over the width of the card top bar. The rod or the like may be accommodated within the carrier. The ends of the rod or the like may extend out beyond the carrier on both sides, in the form of card top heads.

Where a compensating layer is present, that may be of plastics material or the like, for example of a synthetic resin such as epoxy resin, or of polyester or the like. The plastics material, synthetic resin or the like may be curable, and/or may be pourable. It may be, for example, an adhesive. The plastics material, synthetic resin or the like advantageously adheres more strongly to the clothing carrier than at the bottom surface of the carrying member. The compensating layer may be a rigid foam. Advantageously, an adhesive layer may be provided between the compensating layer and the bottom surface of the card top bar. A compensating step may be provided in the bottom surface of the carrying member.

The card top bar and the card top clothing are associated with the same reference plane. The reference plane may be a flat counterpart surface for the tip of the card top clothing, for example a plate or the like. The card top carrying member may be an extruded member of a light metal, for example aluminium, which is advantageously hollow and may be cut to length, for example by sawing. Advantageously, the cut-to-length carrying member can be straightened. Two end head-pieces (card top heads) may be associated with the carrier. Advantageously, a carrying element for the card top clothing, for example of textile material, and a compensating layer are arranged at a recess in the bottom surface of the carrying member. Advantageously, a spacing between the sliding surfaces at the card top heads on the outer surface of the slideway and the envelope curve of the card top clothing tips is even.

The card top heads may lie on a reference plane, for example a flat metal member or the like. The reference plane may be a magnetic plate. The plate and the reference plane may be attached to a common holding element. The reference plane and a further reference plane coinciding with the clothing tips may be orientated parallel to one another. The spacing between the reference planes may be adjustable.

For manufacture, the clothing tips are set down on the further reference plane and the card top heads are set down on the reference plane, and an intermediate layer is applied between the carrying member and the clothing strip. The intermediate layer may be applied by melting, for example, after warming or otherwise heating. The underside of the carrying member may be structured, for example having recesses, protrusion, holes or the like. The carrier may have lateral recesses, grooves or the like for engagement of the fixing elements. Fixing elements may be present on the carrying members for engagement with the bottom surface of the carrier. The carrying member may have lateral shoulders, recesses or the like for engagement of fixing elements present on the carrier. For fixing the clothing portion, fixing means for example resilient snap-in elements may be attached to the carrier.

DESCRIPTION OF THE PREFERRED EMBODIMENTS

Figure 1:
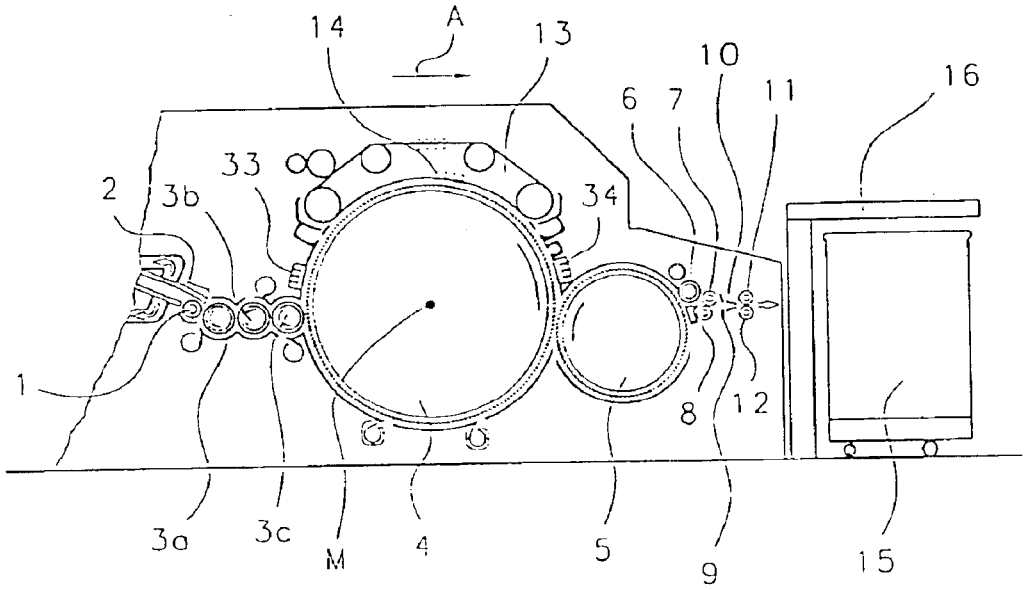
FIG. 1 is a diagrammatic side view of a carding machine having the apparatus according to the invention.

With reference to FIG. 1 a carding machine, for example a Trützschler DK 903 (trade mark) high-performance carding machine, having a feed roller 1, feed table 2, lickers-in 3*a*, 3*b*, 3*c*, cylinder 4, doffer 5, stripper roller 6, nip rollers 7, 8, web-collecting element 9, web funnel 10, draw-off rollers 11, 12, revolving card top 13 having clothed card top bars 14, can 15 and can coiler 16. Curved arrows indicate the directions of rotation of the rollers. Reference letter A denotes the work direction. Stationary carding elements 33 and 34 are arranged opposite the cylinder clothing 4*a*.

Figure 2:
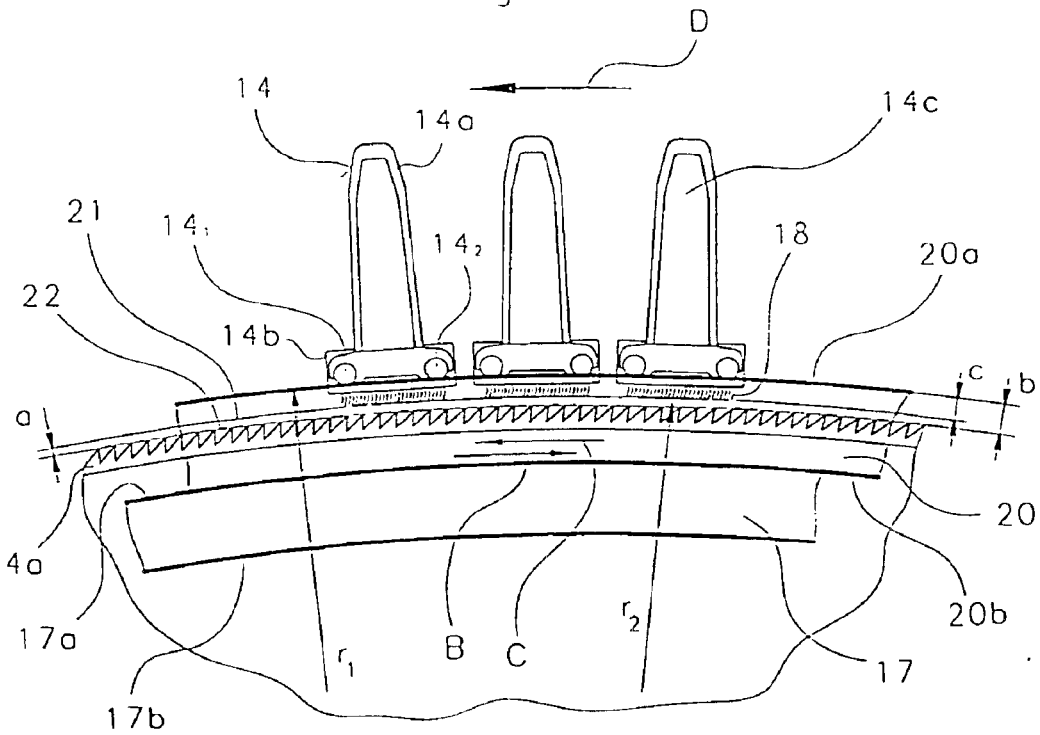
FIG. 2 is a diagrammatic side view of clothed card top bars, portions of a slideway and flexible bend, and the spacing between the card top bar clothing and cylinder clothing.

In accordance with FIG. 2, on each side of the carding machine, a flexible bend 17 having several adjustment screws is fixed laterally to the machine frame. The flexible bend 17 has a convex outer surface 17*a* and an underside 17*b*. On top of the flexible bend 17 there is a slideway 20, for example made of low-friction plastics material, which has a convex outer surface 20*a* and a concave inner surface 20*b*. The concave inner surface 20*b* rests on top of the convex outer surface 17*a* and is able to slide thereon in the direction of arrows B, C. Each card top bar, which may be constructed, for example, in accordance with EP 0 567 747 A1, consists of a rear part 14*a* and a carrying member 14*b*. The carrying member 14*b* has a bottom surface 14*c*, two lateral surfaces 14*d*, 14*e* and two upper surfaces 14*f*, 14*g* (see FIG. 3*a*). Each card top bar 14 has, at each of its two ends, a card top head 14', 14" (cf. FIG. 5), each of which comprises two steel pins $\mathbf{14}_1$, $\mathbf{14}_2$ and $\mathbf{14}_3$, $\mathbf{14}_4$, respectively, a portion of which in the axial direction is fixed in a compensating layer 24. Those portions of the steel pins $\mathbf{14}_1$, $\mathbf{14}_2$ (see FIG. 9) that extend out beyond the end faces of the carrying member 14*b* slide on the convex outer surface 20*a* of the slideway 20 in the direction of the arrow D. The clothing strip 18 is attached to the underside of the carrying member 14*b*. Reference numeral 21 denotes the circle of tips of the card top clothings 19. The cylinder 4 has on its circumference a cylinder clothing 4*a*, for example a saw-tooth clothing. Reference numeral 22 denotes the circle of the tips of the cylinder clothing 4*a*. The spacing between the circle of tips 21 and the circle of tips 22 is denoted by reference letter a and is, for example, 3/1000". The spacing between the convex outer surface 20*a* and the circle of tips 22 is denoted by reference letter b. The radius of the convex outer surface 20*a* is denoted by reference letter $r_1$ and the radius of the circle of tips 22 is denoted by reference letter $r_2$. The radii $r_1$ and $r_2$ intersect at the centre point M of the cylinder 4.

Figure 3A:
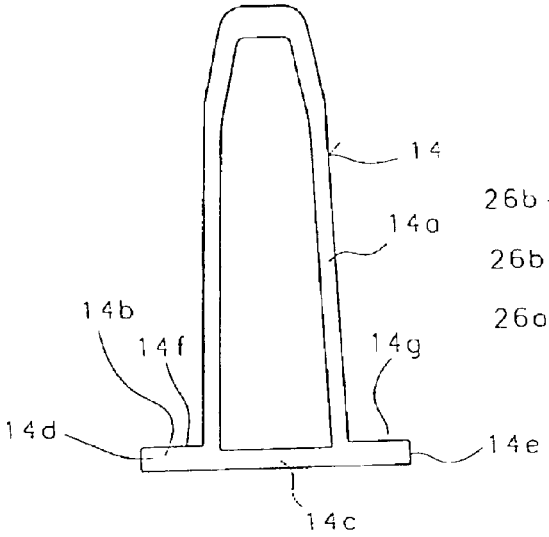
FIG. 3*a* is a sectional side view of the rear part and carrying member of the card top bar.

In accordance with FIG. 3*a*, the card top bar 14, which is extruded from aluminium, is composed of the rear part 14*a* and the carrying member 14*b*. The carrier 26 according to FIG. 3*b*, which is extruded from aluminium, is composed of a holding element 26*a* and two fixing elements 26*b* and 26*c*. The free end regions $\mathbf{26}b_2$ and $\mathbf{26}c_2$ of the holding elements 26*b* and 26*c* are bent at right angles in different directions. They may, in each case, also be bent at an acute angle. The carrier 26 is made of one piece from one material. The fixing elements 26*b* and 26*c* may also be attached to the holding element 26*a*, for example by laser welding. The fixing elements 26*b*, 26*c* and the holding element 26*a* may also be made from different materials. The regions $\mathbf{26}a_2$ and $\mathbf{26}a_3$ are used for additional holding of the carrying element 23 for the clothing strip 18 (see FIG. 3*c*). In accordance with FIG. 3*c*, the clothing strip 18 consists of clothing tips 19 (small wire hooks) and a carrying element 23 made from a textile material. Reference letter f denotes the thickness of the carrying element 23. At one of their ends, the small wire hooks 19 are fixed in the carrying element 23, through the surface 23'. At the other end, the small wire hooks 19, that is to say the clothing tips, are free.

Figure 3B:
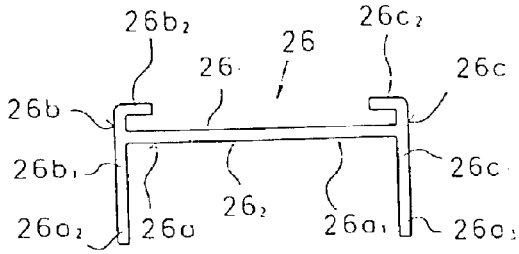
FIG. 3*b* is a a side view of a carrier.
Figure 3C:
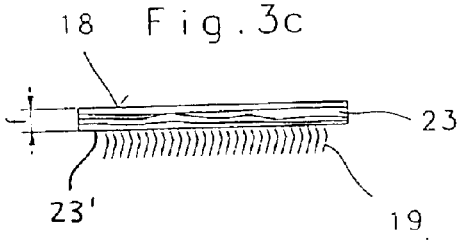
FIG. 3*c* is a side view of a clothing strip.
Figure 3D:
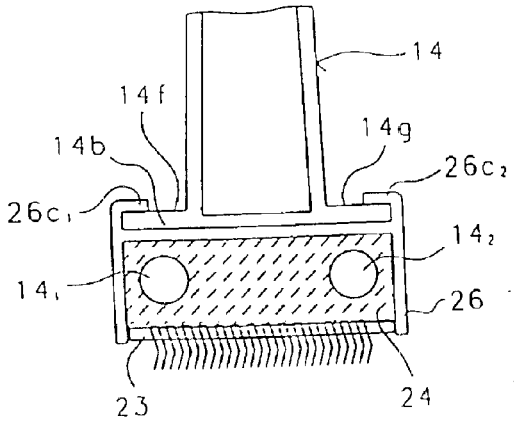
FIG. 3*d* shows the card top bar having the apparatus according to the invention, in an assembled state.
Figure 4A:
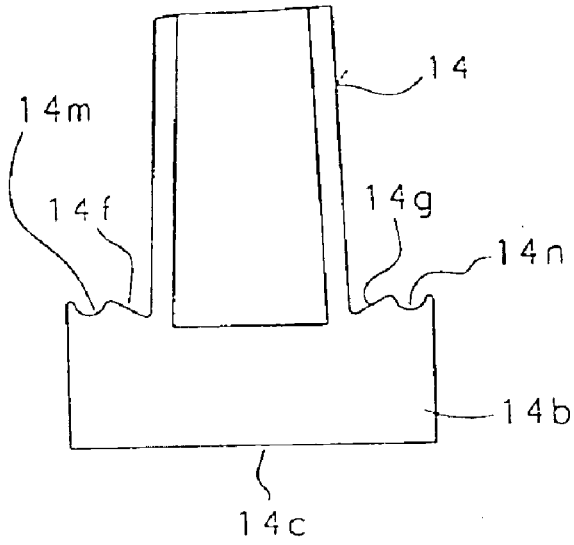
FIGS. 4*a*, 4*b* show a further arrangement of the card top bar and holding element, having a click and snap-in connection.
Figure 4B:
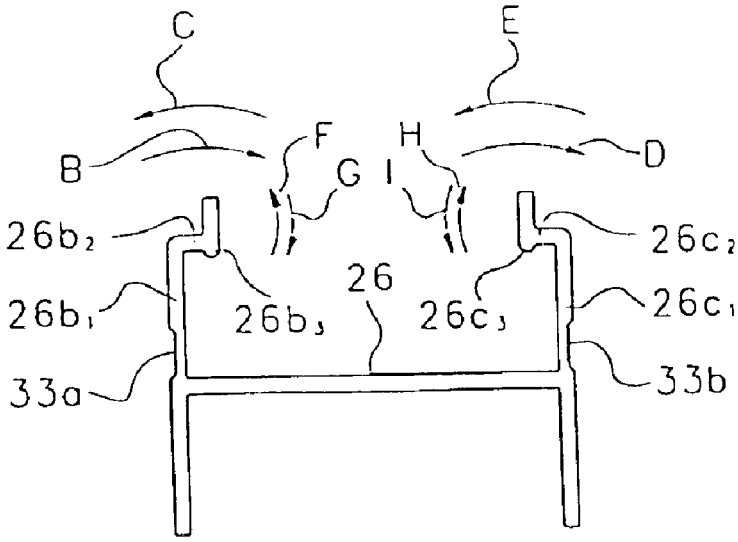

FIG. 3*d* shows the card top bar 14 according to FIGS. 3*a* to 3*c* in the assembled state. The clothing strip 18 is fixed to one face $\mathbf{26}_2$ (the inner face) of the carrier 26. The other face $\mathbf{26}_1$ (the outer face) of the carrier 26 lies against the carrying member 14*b*. The end regions $\mathbf{26}b_2$ and $\mathbf{26}c_2$ of the fixing elements 26*b* and 26*c*, respectively, press against the upper surfaces 14*f* and 14*g*, respectively, of the carrying member 14*b*, as a result of which the carrier 26, together with the clothing strip 18, is fixed to the card top bar 14. Arranged between the inner face $\mathbf{26}_2$ of the carrier 26 and the carrying element 23 is an intermediate layer 24, for example made from cured synthetic resin or the like which may act as a compensating layer. The compensating layer 24 is able to compensate for disparate spacings between the card top bar 14, namely the bottom surface 14*c*, and the card top clothing 19, namely the envelope contour of the free tips. The fixing region for the steel pins $\mathbf{14}_1$, $\mathbf{14}_2$ forming the card top head 14' is arranged in the compensating layer 24 (see FIG. 6). The sliding region of the steel pins $\mathbf{14}_1$, $\mathbf{14}_2$ extends freely outwards, beyond the end face of the compensating layer 24 (see FIGS. 5 and 6). In that manner, the card top heads 14', 14" and the holding device—which, in accordance with FIG. 3*d*, is composed of the holding element 26 and the compensating layer 24—for the clothing strip 18 are in engagement with one another and together form a structural unit.

The structural unit consisting of holding element 26, compensating layer 24, clothing strip 18 and card top heads $\mathbf{14}_1$, $\mathbf{14}_2$ is prefabricated separately. A further advantage is that the structural unit can be mounted on the carrying member 14*b*, and removed from the carrying member 14*b*, by simple means both in the manufacturing factory and at the user's premises, that is to say in the spinning room itself. The structural unit can be supplied to the user in the form of a prefabricated replacement part.

Figure 5:
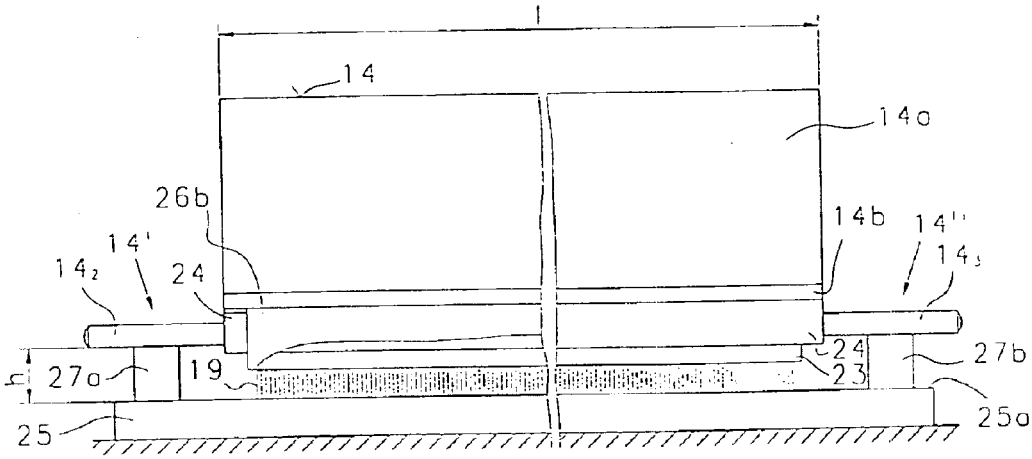
FIG. 5 shows, in a side view and partly in section, an arrangement according to the invention, having a device for alignment of the card top bar for application of a compensating layer.
Figure 6:
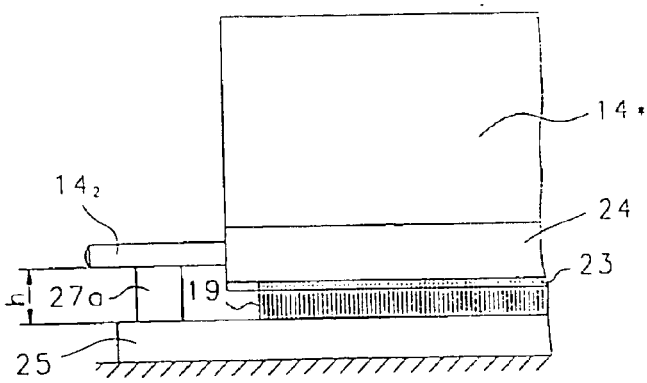
FIG. 6 is a detailed view of a part of the arrangement according to FIG. 5.

FIG. 5 shows an arrangement suitable for manufacturing a card top bar according to the invention. Arranged in a fixed position on a flat plate 25, between the card top pins $\mathbf{14}_1$, $\mathbf{14}_2$ and the plate 25, is a parallelepipedal supporting element 27*a* having parallel and flat surfaces and, between the card top pins $\mathbf{14}_3$, $\mathbf{14}_4$ and the plate 25, a further parallelepipedal supporting element 27*b* of the same height h. Using this apparatus and further lateral fillet elements (not shown) or the like (for example, displaceable boundary surfaces for the compensating layer 24 and/or the carrying element 23), it is possible to position the clothing tips 19 of the clothing strip 18 on the plate 25 and the pins $\mathbf{14}_1$, $\mathbf{14}_2$, $\mathbf{14}_3$, $\mathbf{14}_4$ on the supporting elements 27*a*, 27*b*. The compensating layer 24 is then introduced between the carrier 26 and the carrying element 23. That may be accomplished by, for example, pouring it in, injecting it, spreading it in, laying it in or the like. The compensating layer 24, for example of paste-like consistency, becomes distributed in the intermediate space, filling it in compensating manner. In accordance with FIG. 6, there is provided a static carrier element 14*, which can, for example, in accordance with FIG. 3*a*, be constructed in the form of a T-carrier or the like. The receiving portion for the card top pins $\mathbf{14}_2$ may consist of, for example, a poured compound/adhesive, construction foam or the like. The height h always has the same dimension in the case of all card top bars, thereby eliminating dimensional tolerance. The fixing region of the card top pin $\mathbf{14}_2$ is arranged in the compensating layer 24, and the free end thereof—the region sliding on the slideway 20*a* of the sliding bend 20 (see FIG. 2)—is located outside the compensating layer 24.

Figure 7:
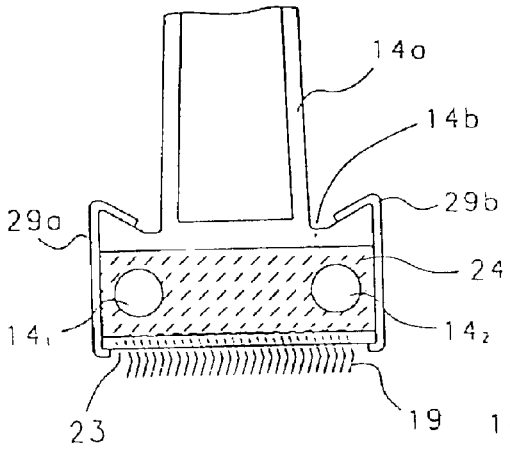
FIGS. 7 to 10 show further embodiments of the apparatus according to the invention.

In the embodiment of FIG. 7, separate spring clips 29*a*, 29*b* are provided, by means of which the structural unit composed of compensating layer 24, clothing strip 18 (consisting of clothing 19 and carrier 23) and card top pins $\mathbf{14}_1$, $\mathbf{14}_2$ ($\mathbf{14}_3$ and $\mathbf{14}_4$ are not shown) is releasably fixed to the carrying member 14*b* of the card top bar 14.

Figure 8:
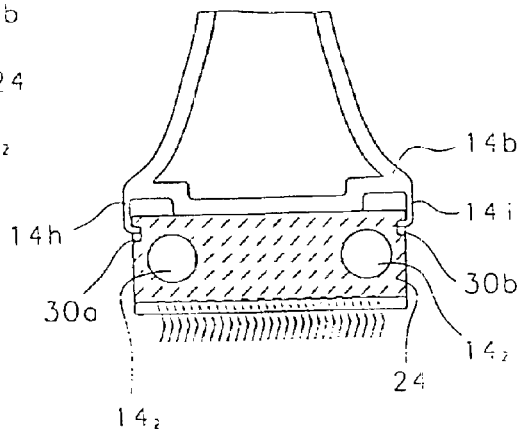

FIG. 8 shows an embodiment wherein resilient clips 14*h*, 14*i* are integrally formed on the carrying member 14*b*, for example during extrusion. As a result, the clips 14*h*, 14*i* are integrated into the card top bar 14. The compensating layer 24 has longitudinal grooves 30*a*, 30*b* on its sides, extending in the width-wise direction, in which the bent-over free ends of the resilient clips 14*h*, 14*i* releasably engage.

Figure 9:
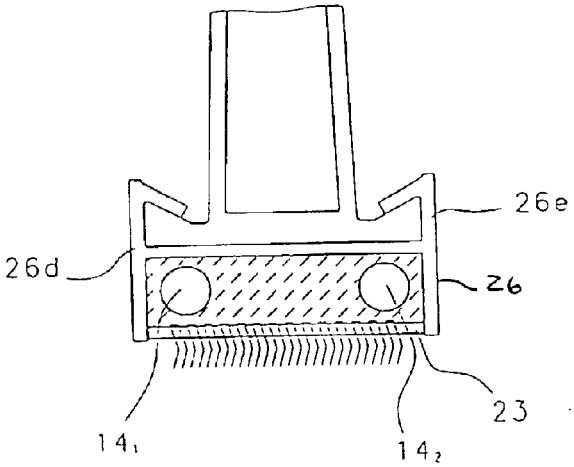

FIG. 9 shows an embodiment, wherein resilient clips 26*d*, 26*e* are integrally formed on the carrier 26, for example during extrusion. As a result, the clips 26*d*, 26*e* are integrated into the carrier 26. The clips have, on their free ends, engagement portions, which are in releasable engagement with corresponding engagement surfaces on the carrying member 14*b*. The parts in engagement with one another may be bent over, for example at an acute or obtuse angle.

Figure 10:
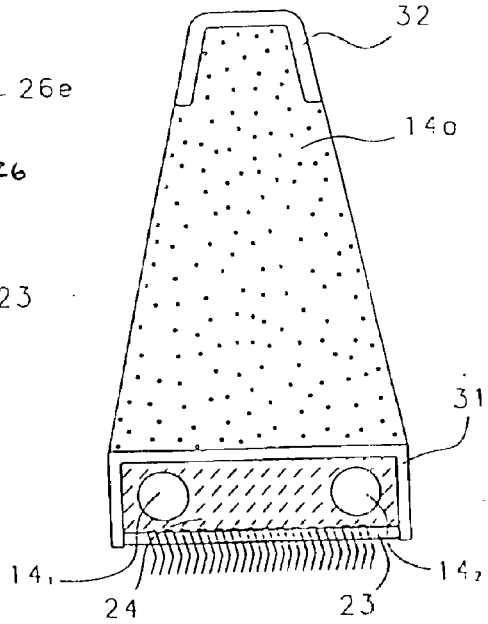

In the embodiment of FIG. 10, the compensating layer 24 is enclosed by an approximately U-shaped tension bar 31 made from metal, above which the rear part 14*a* of the card top bar 14 is formed from rigid foam or the like. Provided at the top of the rear part 14*a* is an approximately U-shaped compression bar 32 made from metal. The compression bar 32 and tension bar 31 equalise forces and stabilise the rear part 14*a*. The statically supporting part is also integrated into the wearing component. A sandwich construction makes that technically possible. This solution precludes the need for on-site assembly.

The apparatus according to the invention substantially reduces the flatness tolerance and dimensional tolerance, measured over the clothing surface, within a card top set consisting of several card top bars 14. A further important advantage is that, when clothings are replaced at the customer's premises, the installation work is reduced. As a result of the invention, the interface between pins (and clothing) is shifted. The pins are an integral part of the wearing portion, namely the clothing. As especially FIGS. 3*d*, 5, 6 and 7 to 10 show, the clothing 19, material 23, tolerance-compensating layer 24 and card top pins $\mathbf{14}_1$, $\mathbf{14}_2$ form one component. It is accordingly possible for dimension h always to be kept the same and for the customer to be provided with a component in which precision is already in-built.

FIGS. 7 to 10 show, by way of example, secure and simple mounting of this unit (component) on the static carrier. It is envisaged, however, that any convenient form of mounting may be used for that purpose.

What is claimed is:

1. A card top bar for a carding machine, having a carrying member and a releasable clothing portion, the clothing portion having clothing, a carrier for the clothing, and two card top heads, the card top heads comprising at least one sliding region arranged for sliding, in use, on a slideway, wherein the card top heads and the carrier for the clothing are in engagement with one another and form a structural unit.

2. A card top bar according to claim 1, in which the carrier is of one-piece construction.

3. A card top bar according to claim 1, in which the carrier comprises a carrying element for the clothing and a compensating layer.

4. A card top bar according to claim 3, in which the compensating layer is arranged between the carrying element and the carrying member.

5. A card top bar according to claim 3, in which the card top heads are in engagement with the compensating layer.

6. A card top bar according to claim 1, in which the card top heads are in direct engagement with the carrier.

7. A card top bar according to claim 1, in which the card top heads are non-releasably connected to the carrier.

8. A card top bar according to claim 1, in which the clothing portion comprises the carrier, the clothing and the card top heads, and is separable from the carrying member.

9. A card top bar according to claim 8, in which the carrying member and the clothing portion are connectable to one another by releasable fixing means.

10. A card top bar according to claim 9, in which the releasable fixing means are clips or clamps.

11. A card top bar according to claim 8, in which the carrying member includes fixing means for attachment of the clothing portion thereto.

12. A card top bar according to claim 8, in which the clothing portion includes fixing means for attachment of the carrying member thereto.

13. A card top bar according to claim 1, in which the clothing portion comprises at least one continuous rod extending over the width of the card top bar.

14. A card top bar according to claim 8, in which said continuous rod comprises extending portions extending beyond first and second lateral extremities of the carrier, said extending portions forming the card top heads.

* * * * *